US011820040B2

(12) United States Patent
Huang et al.

(10) Patent No.: US 11,820,040 B2
(45) Date of Patent: Nov. 21, 2023

(54) DETACHABLE PROTECTIVE DEVICE FOR TABLE SAW

(71) Applicant: P&F BROTHER INDUSTRIAL CORPORATION, Taichung (TW)

(72) Inventors: Chih-Yung Huang, Taichung (TW); Po-Hsun Lin, Taichung (TW)

(73) Assignee: P&F Brother Industrial Corporation, Taichung (TW)

( * ) Notice: Subject to any disclaimer, the term of this patent is extended or adjusted under 35 U.S.C. 154(b) by 0 days.

(21) Appl. No.: 17/650,420

(22) Filed: Feb. 9, 2022

(65) Prior Publication Data

US 2023/0249376 A1 Aug. 10, 2023

(51) Int. Cl.
*B27G 19/02* (2006.01)
*B27G 19/08* (2006.01)

(52) U.S. Cl.
CPC ..... *B27G 19/02* (2013.01); *B27G 19/08* (2013.01); *Y10T 83/2077* (2015.04); *Y10T 83/7734* (2015.04)

(58) Field of Classification Search
CPC ..... B27G 19/02; B27G 19/08; Y10T 83/2077; Y10T 83/7734; Y10T 83/773; Y10T 83/732; Y10T 83/872
See application file for complete search history.

(56) References Cited

U.S. PATENT DOCUMENTS

| | | | | |
|---|---|---|---|---|
| 7,475,622 | B1 * | 1/2009 | Chang | B27G 19/02 83/477.2 |
| 8,037,792 | B2 * | 10/2011 | Sasaki | B27G 19/08 83/477.2 |
| 8,413,560 | B2 * | 4/2013 | Liao | B27G 19/08 83/102.1 |
| 10,118,308 | B2 * | 11/2018 | Gass | B27G 19/08 |
| 10,576,561 | B2 * | 3/2020 | Yu | B23D 59/006 |
| 10,882,207 | B2 * | 1/2021 | Gass | B27G 19/08 |
| 2007/0113714 | A1 * | 5/2007 | Burke | B27G 19/08 83/477.2 |
| 2007/0113715 | A1 * | 5/2007 | Burke | B23D 47/04 83/477.2 |
| 2007/0157784 | A1 * | 7/2007 | Gass | B27G 19/08 83/581 |
| 2007/0186739 | A1 * | 8/2007 | Peot | B27G 19/08 83/477.2 |

(Continued)

FOREIGN PATENT DOCUMENTS

| | | | | |
|---|---|---|---|---|
| CN | 101875205 A | * | 11/2010 | B27B 5/16 |
| CN | 103895067 A | * | 7/2014 | B27B 5/16 |

*Primary Examiner* — Laura M Lee
(74) *Attorney, Agent, or Firm* — Rosenberg, Klein & Lee

(57) ABSTRACT

A detachable protective device includes a base support, a mounting unit connected to the base support, and a quick-release unit. The base support has a mounting hole having an engaging portion and an open end portion. The quick-release unit includes a positioning pin extending movably through the mounting hole. The quick-release unit is operable to move the positioning pin between a locked position, where a large-diameter section of the positioning pin is disposed in the engaging portion, and a release position, where a small-diameter section of the positioning pin is disposed in the engaging portion, thereby allowing separation of the mounting unit from the base support.

8 Claims, 11 Drawing Sheets

(56) References Cited

U.S. PATENT DOCUMENTS

| | | | | |
|---|---|---|---|---|
| 2009/0056514 | A1* | 3/2009 | Chen | B27G 19/08 83/544 |
| 2009/0229437 | A1* | 9/2009 | Tanaka | B27G 19/02 83/440.2 |
| 2009/0288303 | A1* | 11/2009 | Liao | B26D 7/00 30/293 |
| 2010/0116113 | A1* | 5/2010 | Wang | B27G 19/02 83/478 |
| 2010/0116114 | A1* | 5/2010 | Liu | B27G 19/02 83/478 |
| 2010/0126324 | A1* | 5/2010 | Liu | B27G 19/08 83/438 |
| 2010/0206153 | A1* | 8/2010 | Jan | B27G 19/08 83/823 |
| 2010/0224044 | A1* | 9/2010 | Lee | B26D 7/22 83/478 |
| 2011/0061506 | A1* | 3/2011 | Frolov | B27G 19/08 83/477.2 |
| 2011/0167976 | A1* | 7/2011 | Liu | B27G 19/08 83/102.1 |
| 2011/0259165 | A1* | 10/2011 | Chiang | B27B 5/29 83/102.1 |
| 2012/0159763 | A1* | 6/2012 | Chiang | B27G 19/02 403/11 |
| 2012/0216665 | A1* | 8/2012 | Gass | B27B 5/29 83/440.2 |
| 2015/0135923 | A1* | 5/2015 | Liao | B27G 19/08 83/478 |
| 2016/0067880 | A1* | 3/2016 | Frolov | B27G 19/02 83/102.1 |
| 2020/0307016 | A1* | 10/2020 | Tsuda | B27G 19/08 |
| 2023/0039598 | A1* | 2/2023 | Watson | B27G 19/02 |

* cited by examiner

DETACHABLE PROTECTIVE DEVICE FOR TABLE SAW

FIELD

The disclosure relates to a detachable assembly of a table saw, more particularly to a detachable protective device for a table saw.

BACKGROUND

Referring to FIGS. 1, 2, and 3, a conventional table saw includes a table 11, a saw blade 12 disposed on the table 11 and jutting out through a top surface of the table 11, and a guard device 13. The guard device 13 includes a base 14, an adapter 15 detachably mounted on the base 14, a protective cover 16 swingably mounted on the adapter 15, and a locking device 17 disposed on the adapter 15 for locking the adapter 15 to the base 14. The base 14 has a mounting hole 141. The mounting hole 141 has an open end 142, and opposite first and second engaging portions 143, 144. The distance between the first engaging portion 143 and the second engaging portion 144 is larger than the width of the open end 142. The locking device 17 has a pull member 171, a crank member 172 pivoted to the pull member 171, a detent pin 173 inserted through the pull member 171 and the adapter 15, and a crankpin 174 inserted through the crank member 172. The crank member 172 has a first end 175 connected to the pull member 171, and a second end 176 opposite to the first end 175 for insertion of the crankpin 174 therethrough. When installing, the detent pin 173 is inserted into the mounting hole 141 until engaging in the first engaging portion 143, then the crankpin 174 is inserted into the mounting hole 141. Afterwards, the pull member 171 is operated to drive, via the crank member 172, the crankpin 174 to move to the second engaging portion 144 of the mounting hole 141, which means that, at this time, the distance between the detent pin 173 and the crankpin 174 is larger than the width of the open end 142. Therefore, the adapter 15 is not allowed to be separated from the base 14.

As illustrated in FIGS. 2, 3, and 4, the structure of the locking device 17 is quite complex and includes a diversity of components; the related manufacturing and assembling are troublesome, and assembling errors may occur. For example, in the assembling process of the guard device 13, the crank member 172 may at times be erroneously disposed outside of the mounting hole 141 instead of being appropriately inserted into the second engaging portion 144 of the mounting hole 141 (see FIG. 4).

SUMMARY

Therefore, the object of the disclosure is to provide a detachable protective device for the table saw, which is easy to manufacture and install.

According to the disclosure, a detachable protective device adapted to be used with a table saw. The table saw includes a table and a saw blade that extends transversely through a top surface of the table. The detachable protective device includes a base support, a mounting unit, two protective covers, and a quick-release unit. The base support is adapted to be fixed to the table and adjacent to the saw blade. The base support has a mounting hole that extends therethrough along an axis. The mounting hole has an engaging portion through which the axis passes, and an open end portion which is disposed at a side of the engaging portion in a direction perpendicular to the axis and which has a width smaller than that of the engaging portion. The mounting unit is detachably connected to the base support. The protective covers are swingably disposed on the mounting unit for covering part of the saw blade. The quick-release unit is disposed on the mounting unit, and includes a positioning pin that extends along the axis and that extends movably through the mounting hole. The positioning pin has a large-diameter section and a small-diameter section. The large-diameter section extends along the axis and has a diameter larger than the width of the open end portion of the mounting hole. The small-diameter section is connected to the large-diameter section, extends along the axis, and has a diameter smaller than the width of the open end portion of the mounting hole. The quick-release unit is operable to move the positioning pin relative to the base support between a locked position, where the large-diameter section is disposed in the engaging portion of the mounting hole and is not allowed to be removed from the mounting hole via the open end portion of the mounting hole, thereby securing the mounting unit to the base support, and a release position, where the small-diameter section is disposed in the engaging portion of the mounting hole, thereby allowing separation of the mounting unit from the base support through removal of the small-diameter section from the mounting hole via the open end portion of the mounting hole.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
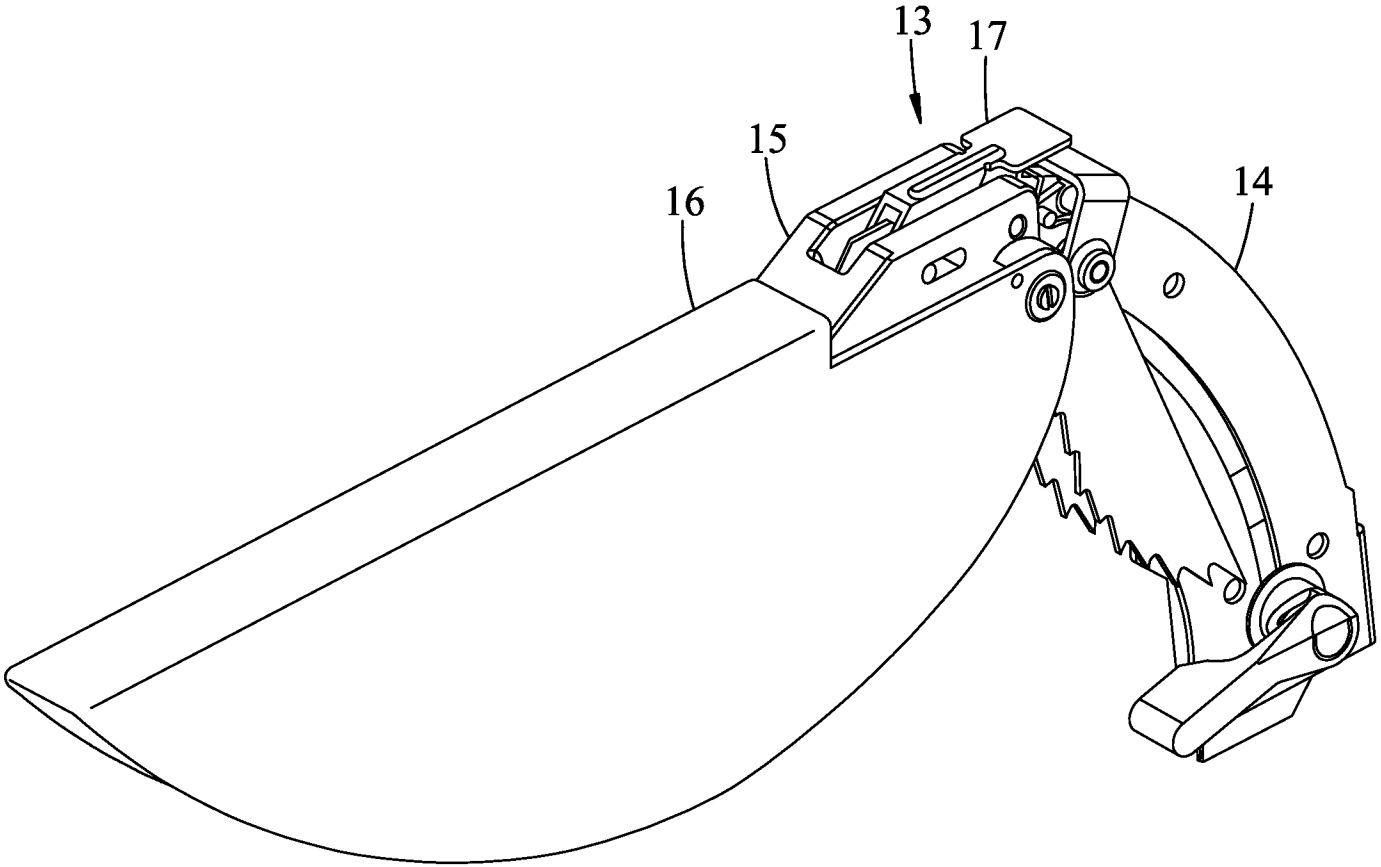
FIG.1 PRIOR ART
FIG. 1 is a fragmentary perspective view of a conventional detachable protective device for a table saw.
Figure 2:
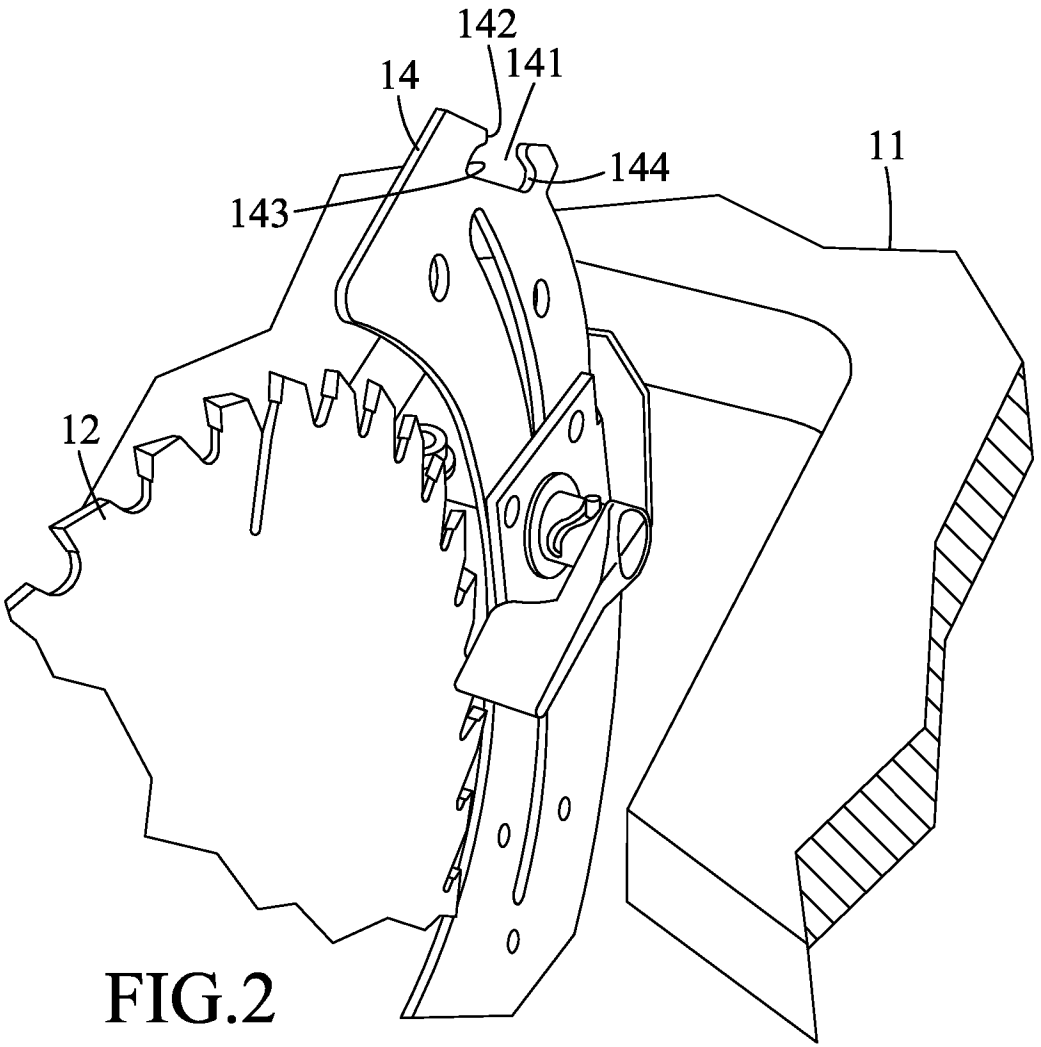
FIG.2 PRIOR ART
FIG. 2 is another fragmentary perspective view of the conventional detachable protective device.
Figure 3:
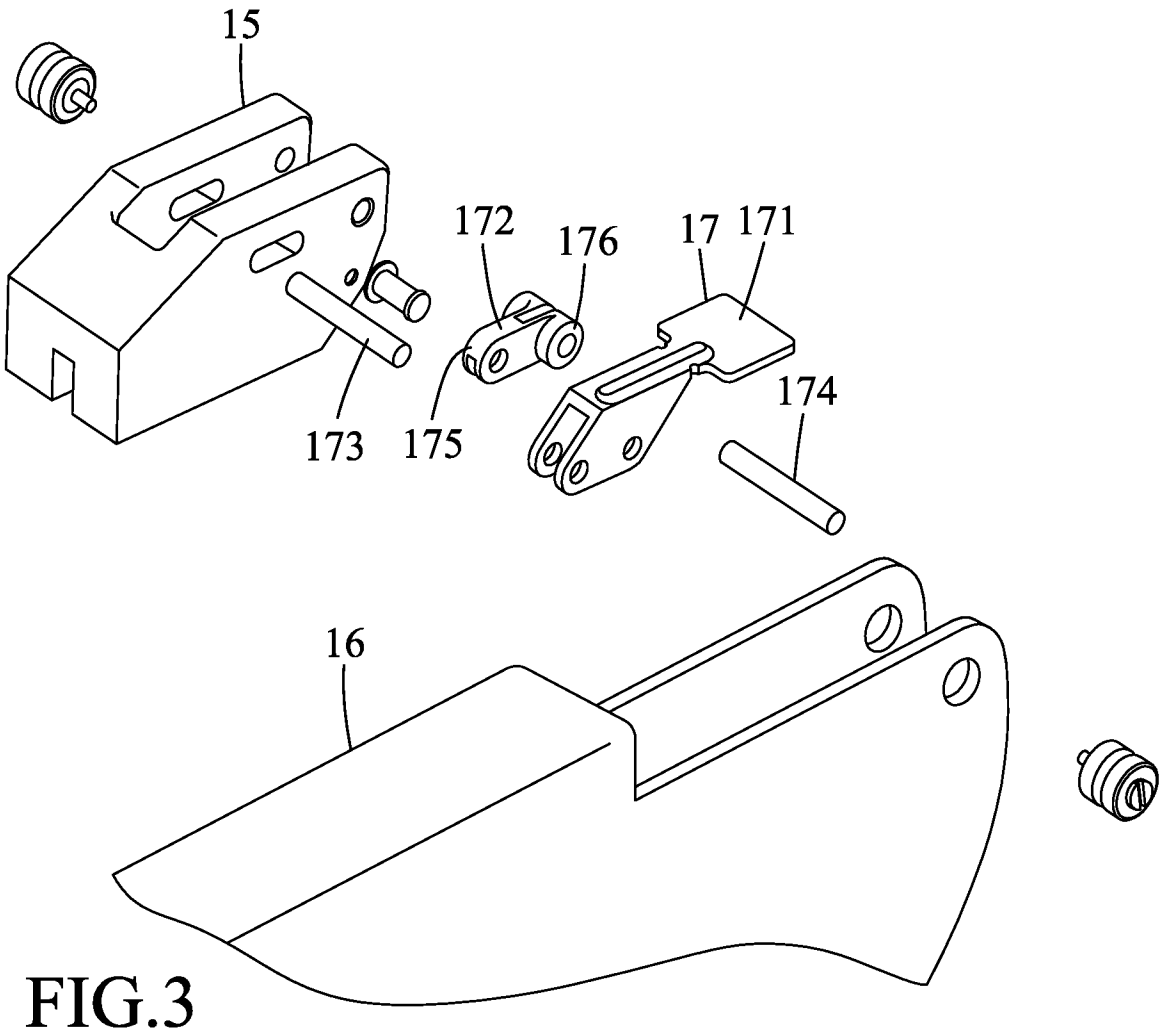
FIG.3 PRIOR ART
FIG. 3 is a fragmentary exploded perspective view of the conventional detachable protective device.
Figure 4:
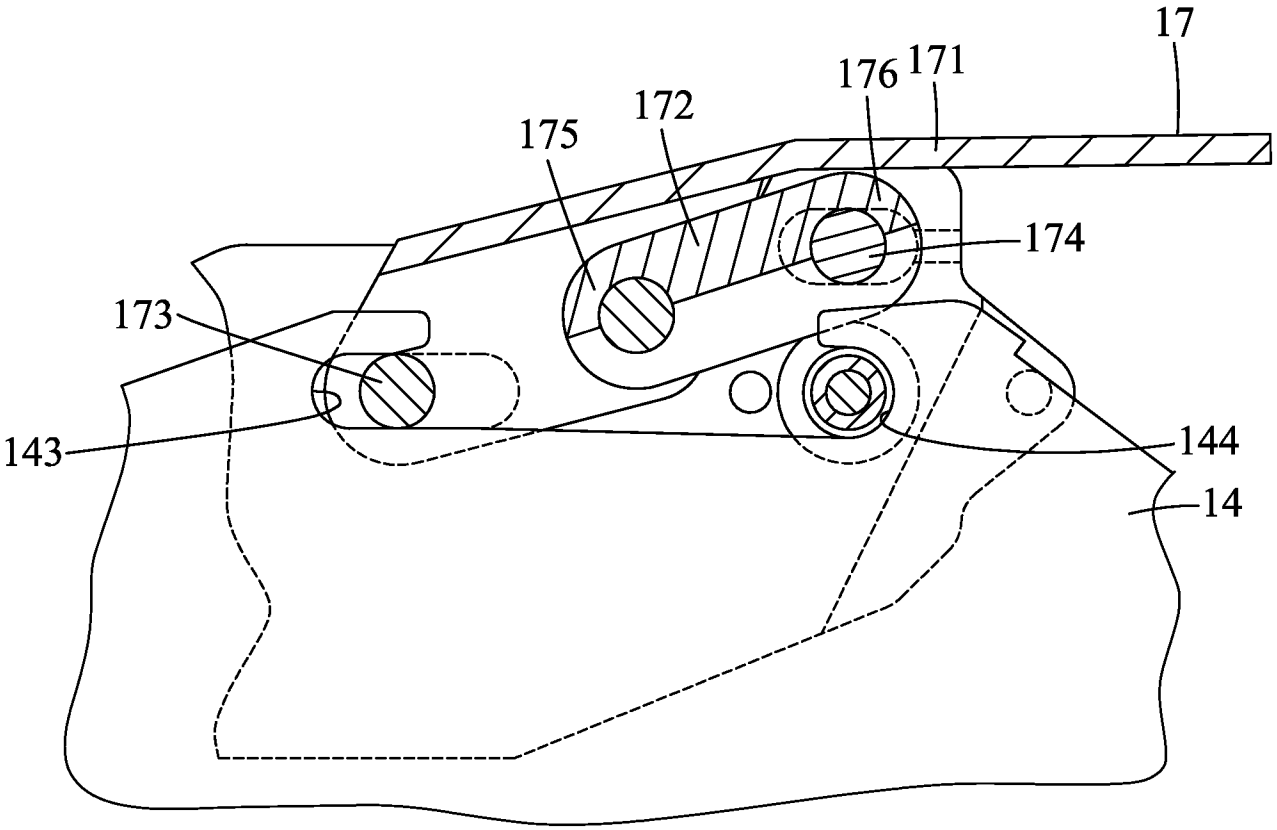
FIG.4 PRIOR ART
FIG. 4 is a fragmentary cross-sectional view of the conventional detachable protective device.
Figure 5:
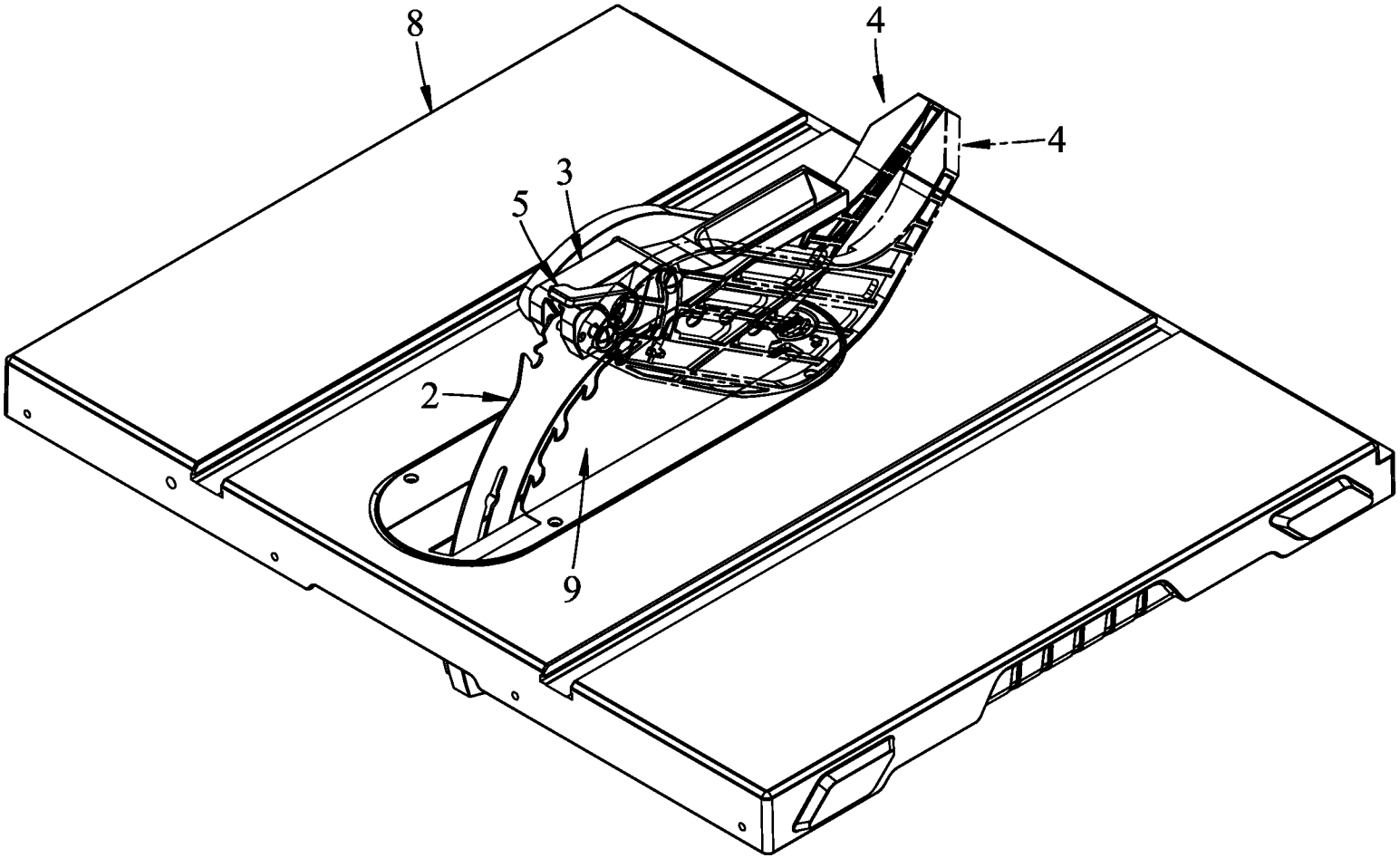
FIG. 5 is a perspective view of an embodiment of the detachable protective device according to the disclosure mounted on a table saw.
Figure 6:
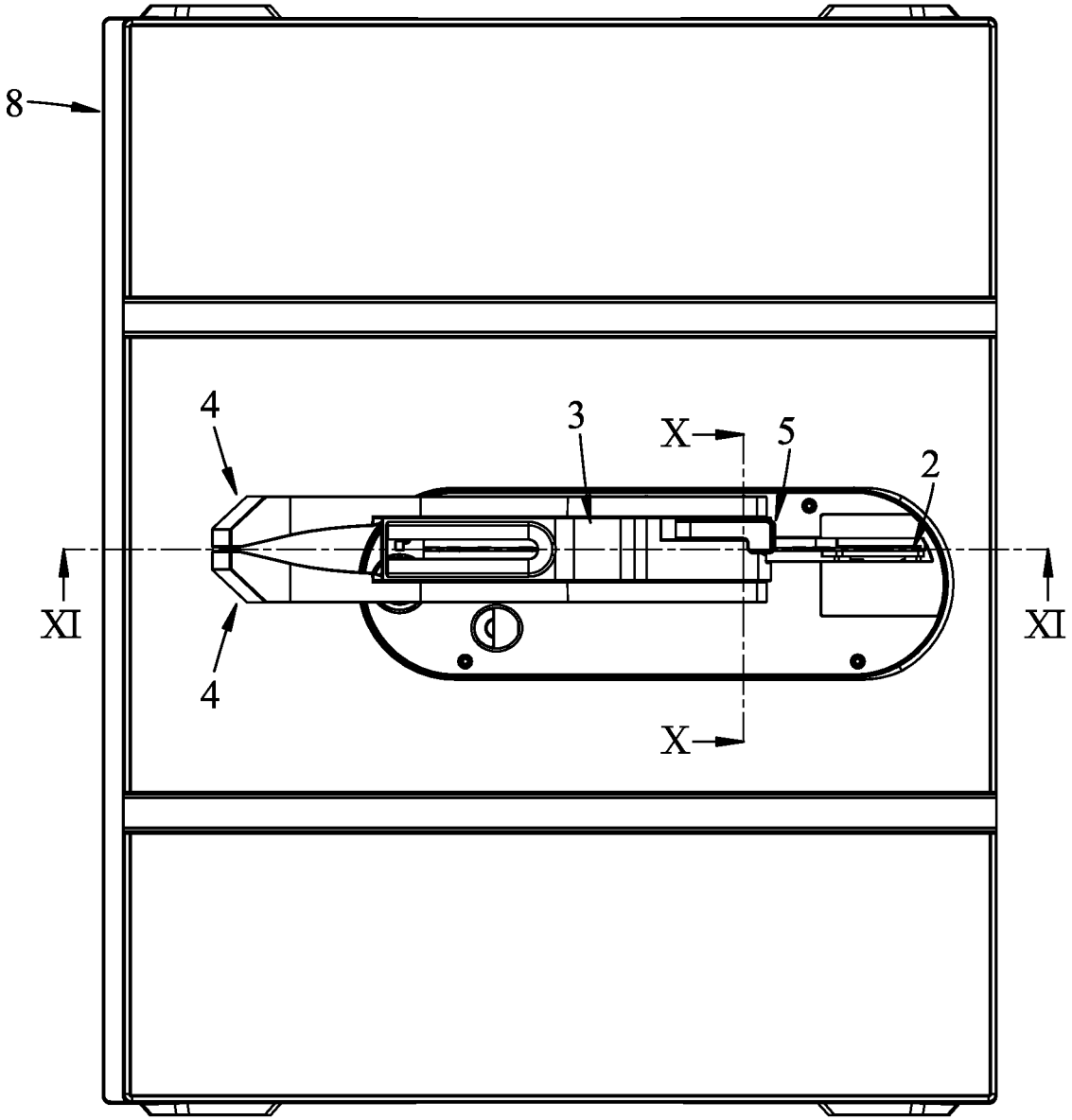
FIG. 6 is a top view of the embodiment.
Figure 7:
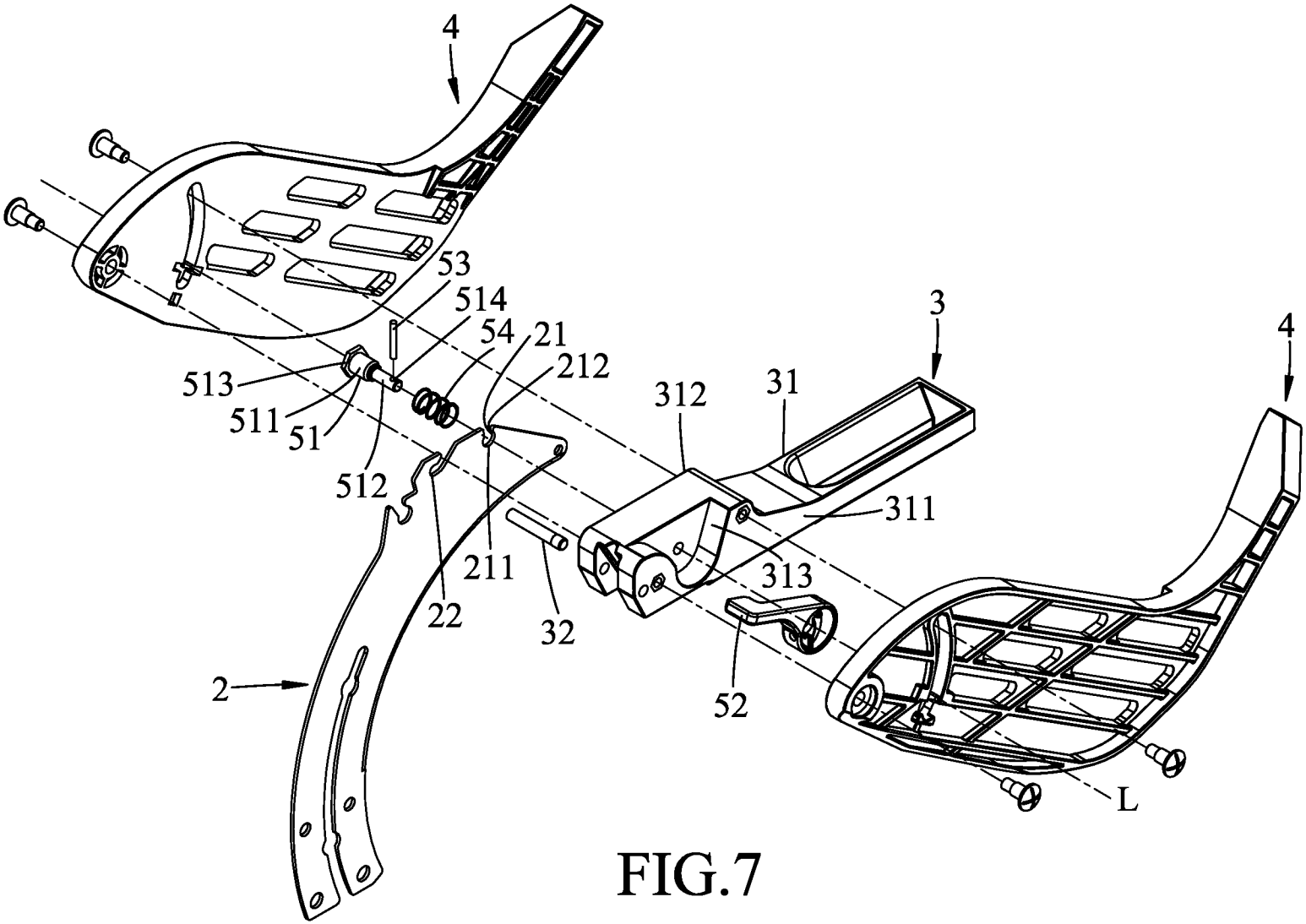
FIG. 7 is an exploded perspective view of the embodiment.

As shown in FIGS. 5 to 7, an embodiment of the detachable protective device according to the present disclosure is adapted to be used with a table saw that includes a table 8 and a saw blade 9 extending transversely through a top surface of the table 8. The detachable protective device includes a base support 2, a mounting unit 3, two protective covers 4, and a quick-release unit 5.

The base support 2 is adapted to be fixed to the table 8 and adjacent to the saw blade 9, and has a mounting hole 21 and a retaining notch 22, both formed on the top of the base support 2. The mounting hole 21 extends through the base support 2 along an axis (L), and has an engaging portion 211 through which the axis (L) passes, and an open end portion 212 which is disposed at a side of the engaging portion 211 in a direction perpendicular to the axis (L) and which has a width smaller than that of the engaging portion 211. The retaining notch 22 extends through the base support 2 in a direction of the axis (L).

The mounting unit 3 includes a mounting seat 31 detachably connected to the base support 2, and an installation pin 32 extending in the direction of the axis (L) and engaging the retaining notch 22. The mounting seat 31 has a first lateral surface 311 and a second lateral surface 312 opposite in the direction of the axis (L), a mounting recess 313 formed in the first lateral surface 311, a polygonal hole 314 (see FIG. 10) formed in the second lateral surface 312, and an intermediate channel 315 (see FIG. 10) interconnecting the mounting recess 313 and the polygonal hole 314.

The protective covers 4 are swingably disposed on the mounting seat 31 for covering part of the saw blade 9.

Figure 8:
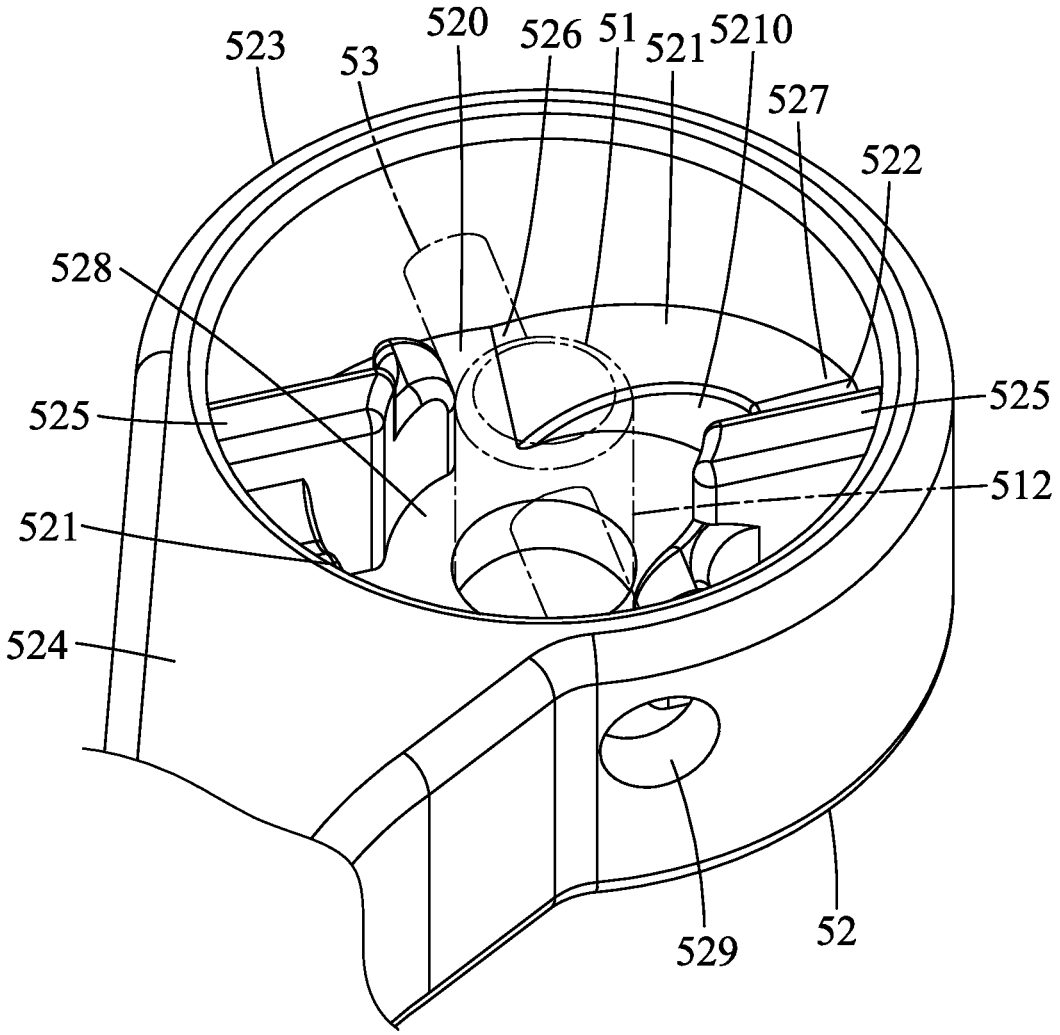
FIG. 8 is a fragmentary perspective view of a pull member of the embodiment.
Figure 9:
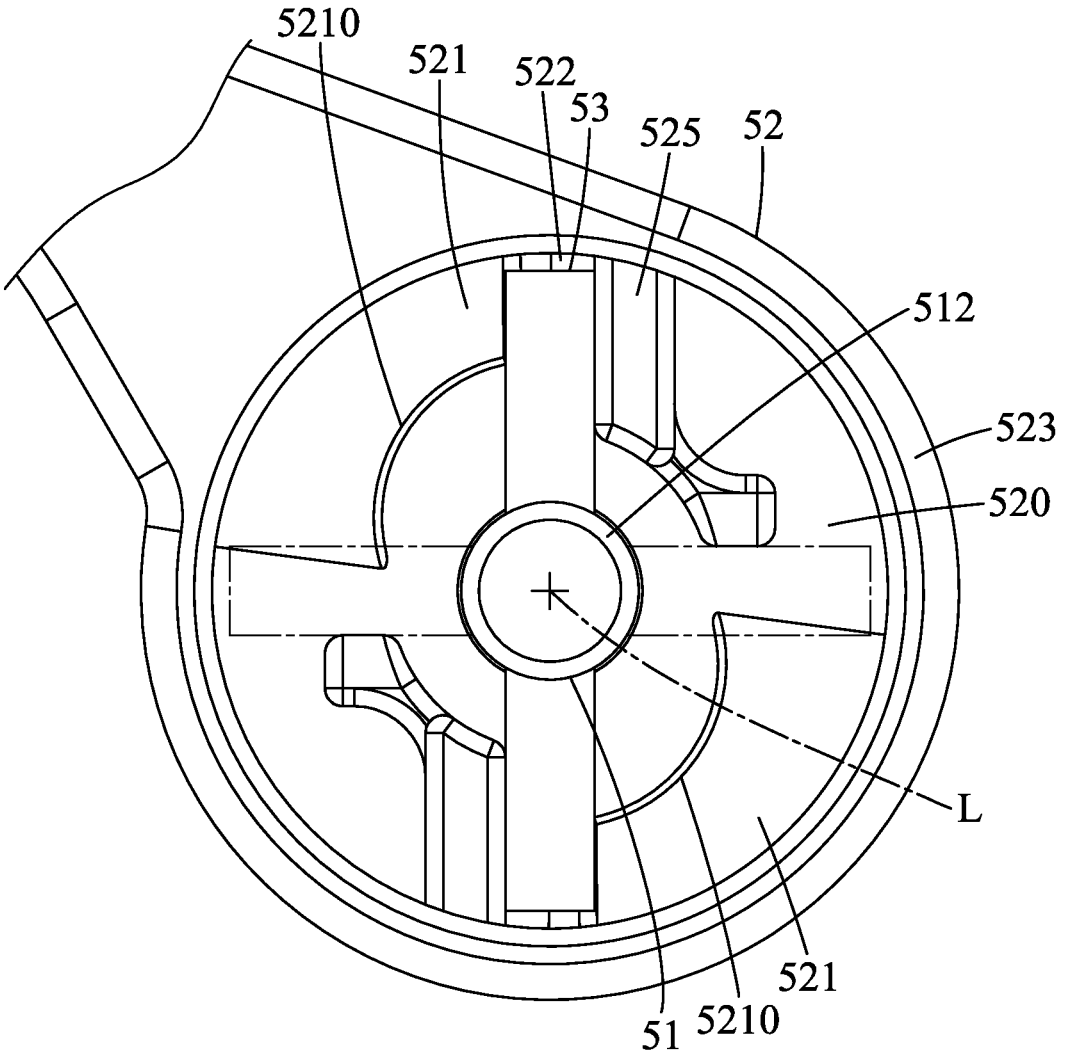
FIG. 9 is a fragmentary side view of a quick-release unit of the embodiment.

Referring to FIGS. 7 to 9, the quick-release unit 5 is disposed on the mounting unit 3. The quick-release unit 5 includes a positioning pin 51 extending through the mounting seat 31 along the axis (L) and extending movably through the mounting hole 21, a pull member 52 disposed in the mounting recess 313 of the mounting seat 31 and swingable about the axis (L), a follower pin 53 perpendicularly extending through the positioning pin 51, and a resilient member 54 disposed between the positioning pin 51 and the mounting unit 3.

Figure 10:
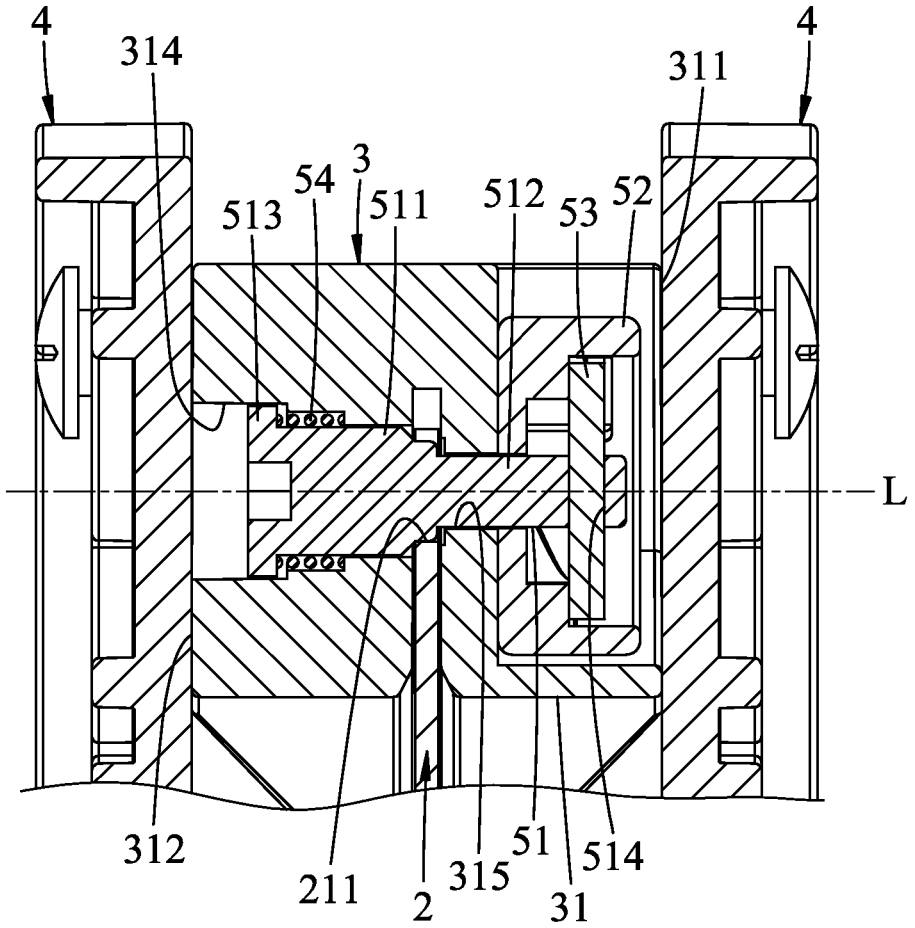
FIG. 10 is a fragmentary cross-sectional view taken along line X-X in FIG. 6.

Referring to FIGS. 7, 9, and 10, the positioning pin 51 has a large-diameter section 511 extending along the axis (L), a small-diameter section 512 connected to the large-diameter section 511 and extending along the axis (L), and an abutting section 513 connected to an end of the large-diameter section 511 opposite to the small-diameter section 512. More specifically, the small-diameter section 512 has an extension hole 514 extending therethrough and being perpendicular to the axis (L). The follower pin 53 extends through the extension hole 514. The large-diameter section 511 has a diameter larger than the width of the open end portion 212 of the mounting hole 21. The small-diameter section 512 has a diameter smaller than the open end portion 212. The abutting section 513 engages the polygonal hole 314 of the mounting seat 31, and has a cross-section that is perpendicular to the axis (L), that is larger than that of the large-diameter section 511, and that corresponds in shape to the polygonal hole 314. The resilient member 54 is biasingly disposed between the abutting section 513 and the mounting seat 31. It should be noted that, in this embodiment, the polygonal hole 314 is hexagonal, and the cross-sectional shape of the abutting section 513 perpendicular to the axis (L) is also hexagonal, thereby preventing the positioning pin 51 from rotating relative to the mounting seat 31. In other embodiments, the polygonal holes 314 and the abutting section 513 may be different shapes as required.

Referring to FIGS. 8 to 10, the pull member 52 has a base wall 520 surrounding the axis (L) and sleeved on the positioning pin 51, and two cam segments 5210 protruding from the base wall 520 away from the mounting unit 3, disposed respectively at opposite sides of the axis (L), and abutting respectively against opposite ends of the follower pin 53. Each of the cam segments 5210 has an inclined cam surface 521 that extends helically and that has opposite first and second ends 526, 527 being respectively adjacent to and distal from the base wall 520, and an engaging groove 522 that is connected to the second end 527 of the inclined cam surface 521. The pull member 52 further has an encircling wall 523 that extends along the axis (L) and that surrounds and is connected to the base wall 520, a handle part 524 that is connected externally to the encircling wall 523, and two stop walls 525 that are connected respectively to the cam segments 5210, that are adjacent respectively to the two engaging grooves 522 of the cam segments 5210, and that extend away from the mounting seat 31 and parallel to the axis (L). The engaging groove 522 of each cam segment 5210 is disposed between the second end 527 of the inclined cam surface 521 of the cam segment 5210 and the respective one of the stop walls 525. The encircling wall 523 defines an accommodating space 528 that opens opposite to the mounting unit 3, that accommodates the two inclined cam segments 5210, and that has an installation hole 529 communicating the external environment and the accommodating space 528.

Figure 11:
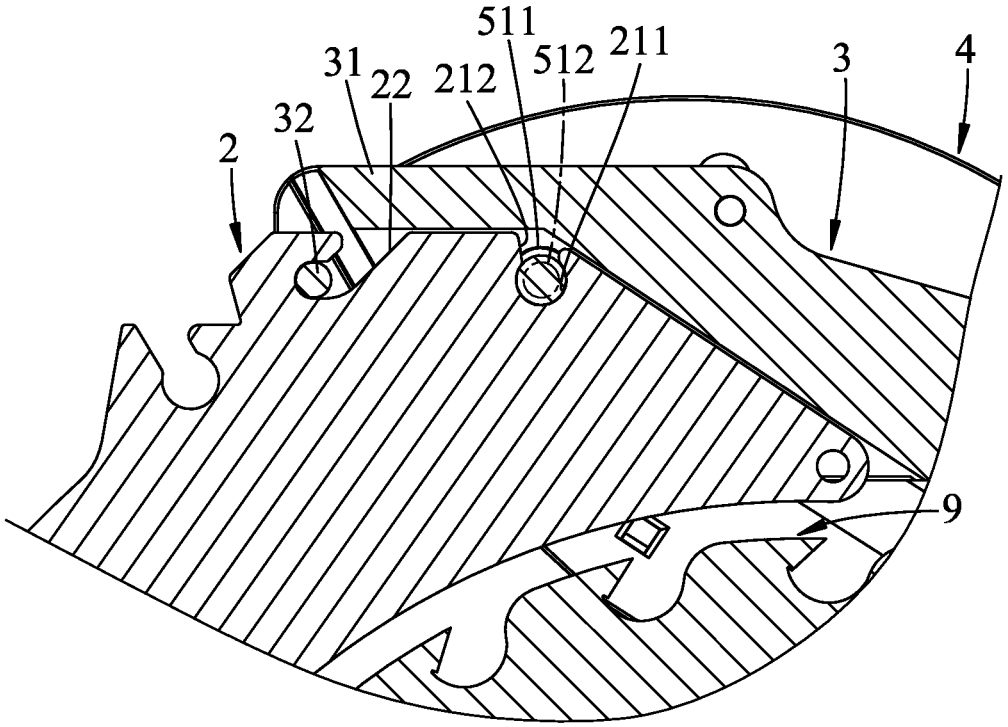
FIG. 11 is a fragmentary cross-sectional view taken along line XI-XI in FIG. 6.

Referring to FIGS. 9 to 11, the quick-release unit 5 is operable to move the positioning pin 51 relative to the base support 2 between a locked position (see FIG. 10 and the solid line positions of FIGS. 9 and 11) and a release potion (see the phantom line positions of FIGS. 9 and 11). When the positioning pin 51 is at the locked position, the opposite ends of the follower pin 53 engage respectively the engaging groove 522, and the large-diameter section 511 of the positioning pin 51 is disposed in the engaging portion 211 of the mounting hole 21 and is not allowed to be removed from the mounting hole 21 via the open end portion 212, thereby securing the mounting unit 3 to the base support 2. When the positioning pin 51 is at the release position, the opposite ends of the follower pin 53 are respectively adjacent to the first ends 526 of the inclined cam surfaces 521, and the small-diameter section 512 of the positioning pin 51 is disposed in the engaging portion 211 of the mounting hole 21, thereby allowing separation of the mounting unit 3 from the base support 2 through removal of the small-diameter section 512 from the mounting hole 21 via the open end portion 212. The resilient member 54 constantly exerts a biasing force on the positioning pin 51 toward the release position.

When assembling, the resilient member 54, the mounting seat 31, and the base wall 520 of the pull member 52 are sleeved on the positioning pin 51, then the follower pin 53 is inserted through the installation hole 529 of the encircling wall 523 into the accommodating space 528 and inserted through the extension hole 514 of the positioning pin 51, thereby assembling the quick-release unit 5 to the mounting unit 3.

Before being ready to use, the installation pin 32 is inserted into the retaining notch 22 of the base support 2 for preliminary positioning and fixation, and then the positioning pin 51 is inserted into the mounting hole 21 of the base support 2. At this time, the small-diameter section 512 of the positioning pin 51 is fitted in the engaging portion 211 of the mounting hole 21. Then, the pull member 52 is swung to make the inclined cam surfaces 521 of the cam segments 5210 move relative to the follower pin 53 until the positioning pin 51 is at the locked position and the opposite ends of the follower pin 53 are inserted respectively into the engaging grooves 522 of the cam segments 5210, In addition, the swing movement of the pull member 52 drives the positioning pin 51 to move along the axis (L) against the biasing force of the resilient member 54, thereby moving the large-diameter section 511 of the positioning pin 51 in the engaging portion 211 of the mounting hole 21. At this time, the mounting unit 3 and the base support 2 are firmly joined. Afterward, the protective cover 4 is swung to a preset position that shields the user from sawdust ejected during cutting, thus protecting the user from injuries, particularly eye injury. When storing the detachable protective device, the pull member 52 is swung in an opposite direction until the opposite ends of the follower pin 53 are respectively in contact with the first ends 526 of the inclined cam surfaces 521 of the cam segments 5210, so that the positioning pin 51 is biased by the resilient member 54 to the release position. Then, the small-diameter section 512 of the positioning pin 51 can be removed from the open end portion 212 of the mounting hole 2, and the installation pin 32 can be detached from the retaining notch 22 to separate the mounting unit 3, the quick-release unit 5, and the protective cover 4 from the base support 2.

Compared with the abovementioned conventional table saw, the mounting unit 3 and the base support 2 of the present disclosure can be easily secured together and be separated from each other by virtue of shifting the positioning pin 51 relative to the base support 2 between the locked position and the release position. Moreover, assembly can be easily carried out by putting the resilient member 54, the mounting seat 31, and the base wall 520 over the positioning pin 51, and then inserting the follower pin 53 through the installation hole 529 of the encircling wall 523 into the accommodating space 528. In addition, through the arrangement of the engaging grooves 522 of the cam segments 5210, in cooperation with the restoring force provided by the resilient member 54, the positioning pin 51 can be firmly maintained in the locked position or the release position even when subjected to moderate external pressure, thus enhancing stability. Furthermore, the stop walls 525 can prevent the follower pin 53 from slipping out of the engaging grooves 522 and further enhance the stability.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A detachable protective device adapted to be used with a table saw, the table saw including a table and a saw blade that extends transversely through a top surface of the table, said detachable protective device comprising:

a base support adapted to be fixed to the table and adjacent to the saw blade, said base support having a mounting hole that extends therethrough along an axis, said mounting hole having an engaging portion through which the axis passes, and an open end portion which is disposed at a side of said engaging portion in a direction perpendicular to the axis and which has a width smaller than that of said engaging portion;

a mounting unit detachably connected to said base support;

two protective covers pivotally disposed on said mounting unit for covering part of the saw blade; and a quick-release unit disposed on said mounting unit, and including a positioning pin that extends along the axis and that extends movably through said mounting hole, said positioning pin having:

a large-diameter section that extends along the axis and that has a diameter larger than the width of said open end portion of said mounting hole, and a small-diameter section that is connected to said large-diameter section, that extends along the axis, and that has a diameter smaller than the width of said open end portion of said mounting hole;

wherein said quick-release unit is operable to move said positioning pin relative to said base support between a locked position, where said large-diameter section is disposed in said engaging portion of said mounting hole and is prevented from being removed from said mounting hole via said open end portion of said mounting hole, thereby securing said mounting unit to said base support, and a release position, where said small-diameter section is disposed in said engaging portion of said mounting hole, thereby allowing separation of said mounting unit from said base support through removal of said small-diameter section from said mounting hole via said open end portion of said mounting hole said quick-release unit further including a pull member disposed on said mounting unit and pivotable about the axis and a follower pin perpendicularly extending through said positioning pin, such that pivoting movement of said pull member drives, via said follower pin, movement of said positioning pin between the locked position and the release position, said pull member having a base wall that surrounds the axis and that is sleeved on said positioning pin, and having two cam segments that protrude from said base wall away from said mounting unit and are disposed respectively at opposite sides of the axis, and abut respectively against opposite ends of said follower pin, each of said cam segments having an inclined cam surface that extends helically and that has opposite first and second ends being respectively adjacent to and distal from said base wall, and an engaging groove that is connected to said second end of said inclined cam surface; and said opposite ends of said follower pin are located respectively adjacent to said first ends of said inclined cam surfaces of said cam segments when said positioning pin is at the release position, and engage respectively said engaging grooves when said positioning pin is at the locked position.

2. The detachable protective device as claimed in claim 1, wherein said pull member further has an encircling wall that extends along the axis and that surrounds said base wall, and a handle part that is connected externally to said encircling wall.

3. The detachable protective device as claimed in claim 2, wherein said encircling wall defines an accommodating space that is opened opposite to said mounting unit, that accommodates said two cam segments, and that has an installation hole communicating the external environment and said accommodating space.

4. The detachable protective device as claimed in claim 1, wherein:

said pull member further has two stop walls connected respectively to said cam segments, being adjacent respectively to said engaging grooves of said cam segments, and extending away from said mounting seat and parallel to the axis; and said engaging groove of each cam segment is disposed between said second end of said inclined cam surface of said cam segment and the respective one of said stop walls.

5. The detachable protective device as claimed in claim 1, wherein:

said base support further has a retaining notch extending therethrough in a direction of parallel to the axis;

said mounting unit includes a mounting seat having a first lateral surface and a second lateral surface that are opposite to each other in a direction parallel to the direction of the axis, and a mounting recess formed in said first lateral surface;

said positioning pin of said quick-release unit extends through said mounting seat;

said mounting unit further includes an installation pin extending in a direction parallel to the direction of the axis and engaging said retaining notch; and said pull member of said quick-release unit is disposed in said mounting recess.

6. The detachable protective device as claimed in claim 5, wherein:

said mounting seat of said mounting unit further has a polygonal hole formed in said second lateral surface, and an intermediate channel interconnecting said mounting recess and said polygonal hole; and said positioning pin further has an abutting section connected to an end of said large-diameter section that is opposite to said small-diameter section, said abutting section having a cross-section that is perpendicular to the axis and that corresponds in shape to said polygonal hole.

7. The detachable protective device as claimed in claim 6, wherein:

said small-diameter section of said positioning pin has an extension hole extending therethrough and being perpendicular to the axis; and said abutting section of said positioning pin has a cross-section perpendicular to the axis larger than that of said large-diameter section.

8. The detachable protective device as claimed in claim 1, wherein said quick-release unit further includes a resilient member disposed between said positioning pin and said mounting unit and constantly exerting a biasing force to said positioning pin toward the release position.

* * * * *